United States Patent [19]

Cottingham

[11] 4,033,156

[45] July 5, 1977

[54] COVER FOR PADLOCK

[76] Inventor: Michael H. Cottingham, 10222 Broadguage Road, Mechanicsburg, Ohio 43044

[22] Filed: Sept. 23, 1976

[21] Appl. No.: 725,706

[52] U.S. Cl. ..... 70/56; 220/339; 174/67

[51] Int. Cl.[2] ..... E05B 67/38

[58] Field of Search ..... 220/3.8, 339, 335; 174/67; 70/52–56; 109/49.5

[56] References Cited

UNITED STATES PATENTS

| | | | |
|---|---|---|---|
| 1,220,941 | 3/1917 | Bowers | 70/56 |
| 3,458,113 | 7/1969 | Swartzbaugh | 220/339 X |
| 3,916,654 | 11/1975 | Mudge, Jr. | 70/56 |

*Primary Examiner*—George T. Hall
*Attorney, Agent, or Firm*—Clarence A. O'Brien; Harvey B. Jacobson

[57] ABSTRACT

A housing is provided including hingedly connected base and cover portions with the base and cover portions including pairs of corresponding peripheral side walls having free marginal edges disposed in close abutting relation when the housing is closed. The peripheral side walls of the base portion extend about and project outwardly from the inner side of a base wall of the base portion and the peripheral side walls of the cover portion extend about and project outwardly from the inner side of an outer wall of the cover portion, the base and outer walls opposing each other when the housing is closed. The free edges of the peripheral side walls of the base and cover portions closely abut each other when the housing is closed and a first pair of corresponding side walls are hingedly connected together while a second pair of corresponding side walls have an outwardly opening notch formed in one side wall thereof and an outwardly projecting tongue formed on the other side wall thereof which is seatingly receivable in the aforementioned notch when the cover portion is in the closed position. However, the outermost extremity of the tongue terminates a spaced distance outwardly from the inner extremity of the notch whereby an entrance slot is defined between the corresponding opposing edges of the second pair of corresponding peripheral side walls for receiving a hasp therethrough. The base wall of the cover portion has apertures formed therethrough with which the apertures formed through the mounting plate of the keeper for a hasp may be registered whereby fasteners may be secured through the registered apertures in order to secure the base wall of the base portion of the housing to a support member. Further, the interior of the housing is of sufficient size to receive a combination or padlock therein engaged with the keeper. In this manner, the keeper, the free swinging end of an associated hasp and a padlock or combination lock securing the hasp to the keeper may be enclosed within the housing and protected against the elements.

13 Claims, 5 Drawing Figures

COVER FOR PADLOCK

BACKGROUND OF THE INVENTION

Various forms of enclosures have been provided to provide protection against the elements of an object which would otherwise be exposed to weather. However, such enclosures adapted specifically for use in conjunction with hasps, hasp keepers and locks securing the hasp to the keeper have not been provided. Accordingly, a need for such a weather enclosure exists.

Examples of various enclosures including some of the structural features of the instant invention are disclosed in U.S. Pat. Nos. 2,997,520, 3,240,375, 3,272,379 and 3,746,207.

BRIEF DESCRIPTION OF THE INVENTION

The enclosure of the instant invention has been specifically designed to provide protection against the elements for a hasp, a keeper with which the hasp is engaged and a padlock or combination lock retaining the hasp in engagement with the keeper. The enclosure is preferably of one-piece construction and manufactured from suitable weather-resistant plastic although other materials may be used.

The main object of this invention is to provide an enclosure for a hasp, the keeper with which the hasp is engaged and a padlock or combination lock securing the hasp to the keeper.

Another object of this invention is to provide an enclosure which may be readily manufactured of different sizes so as to accommodate various hasp and keeper installations.

Yet another object of this invention is to provide an enclosure in accordance with the preceding objects and which may be readily installed for use in conjunction with existing hasp and keeper installations merely upon the removal and remounting of the keeper.

A final object of this invention to be specifically enumerated herein is to provide an enclosure in accordance with the preceding objects and which will conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
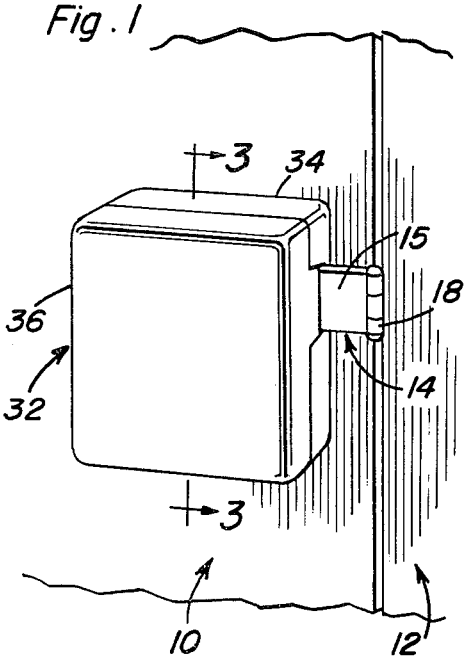
FIG. 1 is a fragmentary perspective view of a typical hasp and keeper installation with the cover or enclosure of the instant invention operatively associated therewith and in a closed condition.

Referring now more specifically to the drawings, the numeral 10 generally designates a first support which is locked relative to a second support generally referred to by the reference numeral 12. The support 10 is locked relative to the support 12 against movement relative thereto by means of a hasp referred to in general by the reference numeral 14 including a base portion 16 secured to the support 12 in a conventional manner and an arm portion 15 hingedly supported from the base portion 16 by means of a conventional hinge assembly 18. The free end of the arm portion 15 is provided with a slot 20 through which the U-shaped anchor portion 22 of a keeper referred to in general by the reference numeral 24 is receivable, the keeper 24 including a mounting plate 26 having apertures 28 formed therethrough.

The cover or enclosure of the instant invention is referred to in general by the reference numeral 30 and includes a housing structure 32 including base and cover portions 34 and 36. The base portion 34 includes a base wall 38 which is generally rectangular in configuration and includes inner and outer surfaces 40 and 42. The base portion 34 includes four peripheral walls 44, 46, 48 and 50 which extend completely about the periphery of the base wall 38 and project outwardly from the inner surface 40 thereof. The peripheral or side wall 46 includes an outwardly opening notch 52 therein having an inner extremity 54 spaced slightly outwardly of the inner surface 40 of the base wall 38.

Figure 2:
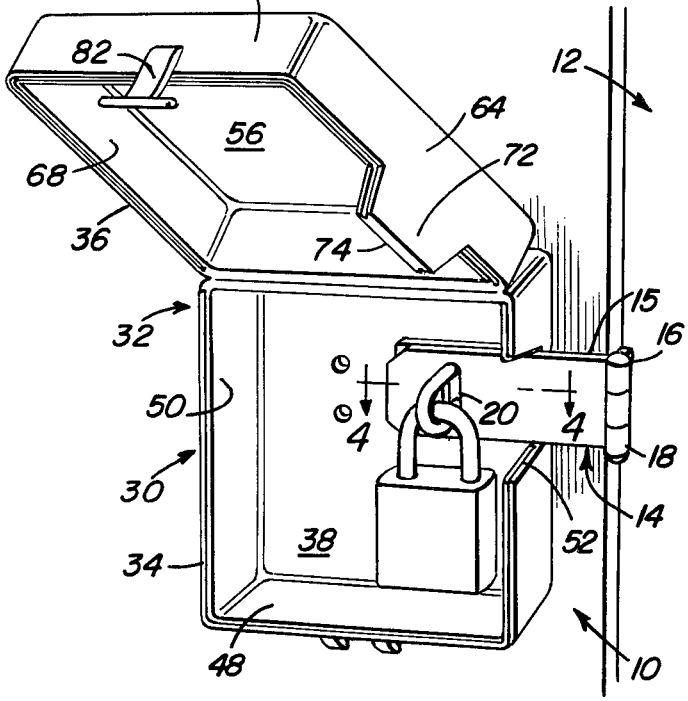
FIG. 2 is a fragmentary perspective view similar to FIG. 1 but on somewhat of an enlarged scale and with the enclosure in an open position.
Figure 3:
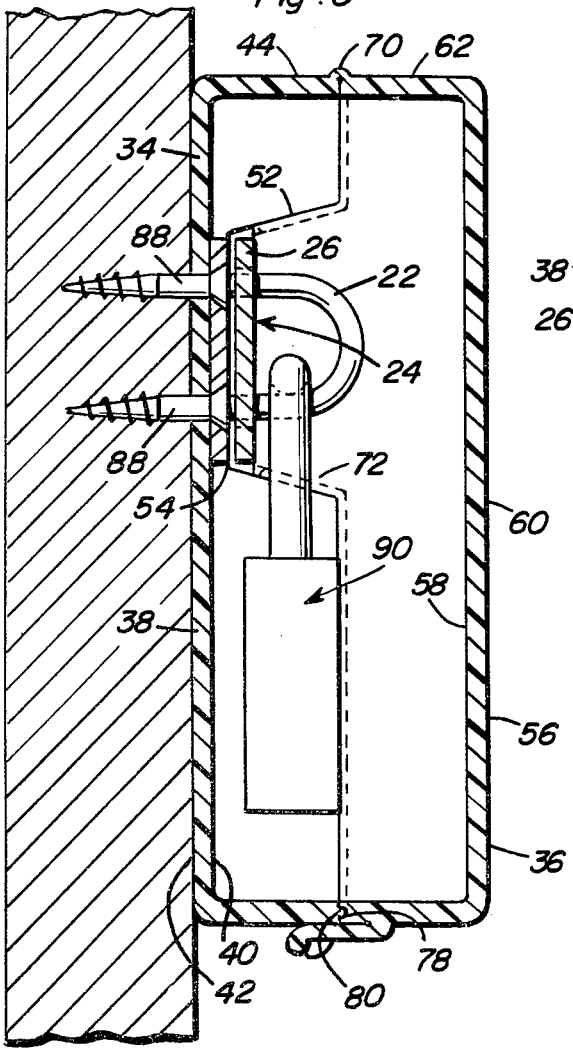
FIG. 3 is an enlarged fragmentary vertical sectional view taken substantially upon the plane indicated by the section line 3—3 of FIG. 1.
Figure 4:
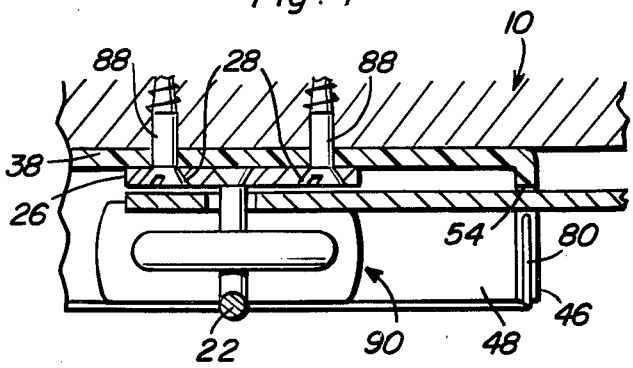
FIG. 4 is a fragmentary enlarged horizontal sectional view taken substantially upon the plane indicated by the section line 4—4 of FIG. 2.
Figure 5:
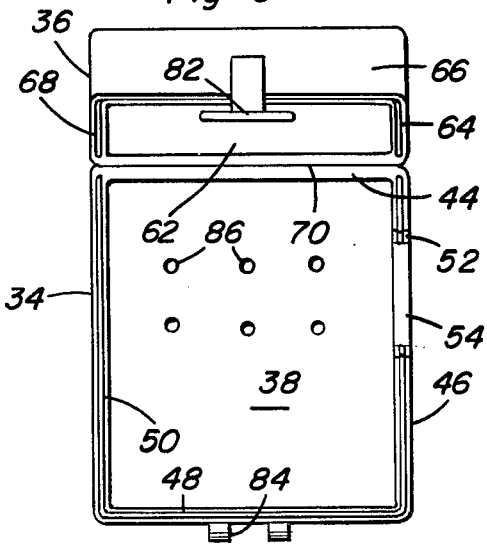
FIG. 5 is a front elevational view of the enclosure with the cover thereof in an open position.

The cover portion 36 includes an outer wall 56 which is also generally rectangular in shape and includes inner and outer surfaces 58 and 60. The cover portion 36 additionally includes peripheral walls 62, 64, 66 and 68 extending thereabout and projecting outwardly from the inner surface thereof. The outer free edges of the walls 44 and 62 are hingedly connected by means of a hinge structure 70 and the cover portion 36 may therefore be swung between the open position thereof illustrated in FIG. 2 of the drawings and the closed position thereof illustrated in FIGS. 1 and 3 of the drawings, the outer marginal edges of the pairs of corresponding side walls 44, 62 and 46, 64 and 48, 66 and 50, 68 are disposed in abutting relation with each other when the cover portion 36 is in the closed position.

The side wall or peripheral wall 64 includes an outwardly projecting tongue 72 which is receivable in the notch 52 and the outer extremity 74 of the tongue 72 terminates a spaced distance outwardly of the innermost extremity 54 of the notch 52 when the cover portion 36 is in the closed position. Also, the edges of the side wall 46 defining the opposite sides of the notch 52 are outwardly divergent and the edges of the side wall 64 defining the opposite sides of the tongue 72 are outwardly convergent. All of the opposing edges of the side walls, except for the side walls 44 and 62, include semi-circular grooves 78 and semi-circular ribs 80 seatable in the grooves 78, the innermost extremity 54 of the notch 52 being devoid of a rib and the outermost extremity 74 of the tongue 72 being devoid of a groove.

The central portion of the side wall 66 includes an integral resilient tab 82 and the free edge portion of the side wall 48 includes a pair of spaced integral lugs 84 between which the tab 82 is receivable in order to lock the cover portion 36 in the closed position.

The base wall 38 is provided with a plurality of apertures 86 formed therethrough and the apertures 28 formed through the plate 26 of the keeper 24 are registrable with the apertures 86 whereby suitable fasteners 88 may be secured through the registered apertures 28 and 86 in order to secure the plate 26 to the inner side 40 of the base wall 38 and the latter to the support 10. It will be noted that the apertures 86 are formed in alignment with the notch 52 formed in the side wall 46 and accordingly, the free swinging end of the arm portion 15 of the hasp 14 may be swung through the notch 52 and into position with the member 22 received through the slot 20. Thereafter, a lock such as the lock referred to in general by the reference numeral 90 may be engaged with the member 22 in order to retain the arm portion 15 of the hasp 14 engaged with the keeper 24. Of course, after the lock 90 has been placed in position the cover portion 36 may be swung from the open position thereof illustrated in FIG. 2 to the closed position thereof illustrated in FIG. 3 and latched in the closed position by means of engagement of the tab 82 with the lugs 84.

The housing 32 is preferably constructed of plastic whereby the entire enclosure may be of one-piece construction, the hinge assembly 70 comprising an integral portion of the side walls 44 and 62.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimd as new is as follows:

1. An enclosure for enclosing the keeper for a hasp, the free swingable end of a hasp operatively associated with the hasp and a lock removably locking the free swingable end of the hasp over said keeper, said enclosure comprising a hollow housing having main and cover portions, said main portion including a base wall having inner and outer sides and adapted to have its outer surface abutted against a support to which the keeper for a hasp is to be secured, said base wall including peripheral walls extending about the peripheral edges thereof and projecting outwardly from the inner side thereof, said cover portion including an outer wall having outer and inner sides and peripheral walls extending about the peripheral edges thereof and projecting outwardly of the inner side thereof, the peripheral walls of said base and cover portions including pairs of corresponding side walls, hinge means hingedly securing the free edge portions of one pair of said corresponding side walls together for swinging movement of the cover portion relative to the base portion between an open position with said cover portion out of registry with the open side of said base portion and a closed position overlying and closing the open side of said base portion with the free edge portions of corresponding pairs of said side walls abutting each other, said base wall having a plurality of mounting apertures formed therethrough adapted to have the mounting apertures of the mounting plate of a hasp overlying the inner surface of said base wall registered therewith for securement of said mounting plate over the inner surface of said base wall and the latter to said support by means of fasteners secured through said registered apertures, a second pair of said corresponding side walls of said base and cover portions having a notch formed therein and an outwardly projecting tongue formed thereon, respectively, said notch including an inner extremity at least closely adjacent said base wall and disposed in a position aligned with a path extending between said apertures and the notched side wall, whereby said hasp may be swung into operative position over the mounting plate of said keeper through said notch, the outer free end of said tongue, when said cover is in said closed position being slightly spaced from said inner extremity, whereby said hasp may be received between said tongue free end and the inner extremity of said notch.

2. The combination of claim 1 wherein the free edges of said pairs of corresponding side walls, other than said one pair of side walls, include coacting grooves and ribs extending therealong defining an overlapping engagement of the free edges of said side walls with each other when said cover portion is in the closed position thereof.

3. The combination of claim 2 wherein the edges of said side wall defining said notch and the corresponding edges of said tongue also include coacting grooves and ribs.

4. The combination of claim 3 wherein said grooves and ribs are generally semicircular in cross-sectional shape.

5. The combination of claim 1 wherein said base and cover portion include four side walls each and each portion side wall is disposed at generally right angles relative to the adjacent side walls of that portion.

6. The combination of claim 1 wherein said notch includes outwardly divergent side edges and said tongue includes corresponding outwardly convergent side edges for close abutting engagement with said notch side edges when said cover portion is in the closed position.

7. The combination of claim 1 wherein the inner extremity of said notch is slightly spaced from said base wall.

8. The combination of claim 1 wherein said enclosure is constructed of plastic.

9. The combination of claim 8 wherein said hinge means is formed integrally with said one pair of corresponding side walls.

10. The combination of claim 9 wherein the free edges of said pairs of corresponding side walls, other than said one pair of side walls, include coacting grooves and ribs extending therealong defining an overlapping engagement of the free edges of said side walls with each other when said cover portion is in the closed position thereof.

11. The combination of claim 10 wherein said notch includes outwardly divergent side edges and said tongue includes corresponding outwardly convergent side edges for close abutting engagement with said notch side edges when said cover portion is in the closed position.

12. An enclosure including a pair of hollow housing sections having corresponding peripheral side walls, open sides, end walls closing the sides thereof remote from the open sides thereof, one pair of corresponding peripheral side walls having their free edges hingedly connected for relative swinging of said sections between open positions with said sections opening in generally the same directions and closed positions with said sections opening toward each other and the free edges of said corresponding peripheral side walls defining said open sides abutting each other, one pair of corresponding side walls including an outwardly opening recess formed in one side wall thereof and a cooperating tongue formed on the other side wall thereof, said recess opening outwardly through the free edge of said one side wall and terminating inwardly a distance slightly spaced from the corresponding end wall, said tongue extending outwardly from the free edge of said other side wall and being seatingly receivable within said recess when said housing sections are in said closed positions with the free end of said extension terminating a distance slightly spaced from the inner extremity of said recess whereby to define a slot through the side of said enclosure of a width substantially equal to the spacing of said slot from the end wall of one of said section, said end wall of said one section having openings formed therethrough adapted to have the openings of a keeper mounting plate abutted against the inner surface of the end wall of said one section registered therewith.

13. The combination of claim 12 wherein the free edges of said pairs of corresponding side walls, other than said one pair of side walls, include coacting grooves and ribs extending therealong defining an overlapping engagement of the free edges of said side walls with each other when said cover portion is in the closed position thereof.

* * * * *